US005511892A

United States Patent [19]

Pickering

[11] Patent Number: 5,511,892

[45] Date of Patent: Apr. 30, 1996

[54] THERMAL PRINTER PLATEN WITH RELIEVED ENDS

[75] Inventor: James E. Pickering, Holcomb, N.Y.

[73] Assignee: Eastman Kodak Company, Rochester, N.Y.

[21] Appl. No.: 263,637

[22] Filed: Jun. 22, 1994

[51] Int. Cl.[6] ..... B41J 11/57

[52] U.S. Cl. ..... 400/662; 400/656; 400/659

[58] Field of Search ..... 400/662, 656, 400/657, 658, 659, 641; 492/27, 28

[56] References Cited

U.S. PATENT DOCUMENTS

| | | | |
|---|---|---|---|
| 4,728,967 | 3/1988 | Tomita et al. | 346/136 |
| 4,934,850 | 6/1990 | Okubo et al. | 400/662 |
| 5,253,026 | 10/1993 | Tamary | 355/289 |

FOREIGN PATENT DOCUMENTS

| | | | |
|---|---|---|---|
| 1316275 | 12/1989 | Japan | 400/662 |
| 472515 | 9/1937 | United Kingdom . | |
| 842785 | 7/1960 | United Kingdom . | |

OTHER PUBLICATIONS

IBM Technical Disclosure Bulletin, vol. 23, No. 1, Jun. 1980 (New York), E. G. Souliere, "Moulded Printer Platen", p. 17.

*Primary Examiner*—John S. Hilten
*Attorney, Agent, or Firm*—Milton S. Sales

[57] ABSTRACT

A resistive thermal printer receives dye donor and dye receiver media between a printhead and a platen having an elastomeric surface. The platen and one of the media is wider than the printhead, and the other media is narrower than the printhead, whereby pressure between the printhead and the platen, with the media there between, tends to compress the platen in the region of the narrow medium. End portions of the platen beyond the narrow medium are relieved so as to not be compressed by pressure between the printhead and the platen.

8 Claims, 4 Drawing Sheets

THERMAL PRINTER PLATEN WITH RELIEVED ENDS

BACKGROUND OF THE INVENTION

1. Technical Field

This invention relates generally to thermal printers which press dye donor and dye receiver media between a printhead and a platen during printing.

2. Background Art

Referring to FIG. 1, a thermal printer 10, known in the art, includes a resistive thermal printhead having a substrate 12 which carries a printhead 14. A dye donor medium (sheet or web) 16 and dye receiver medium (sheet or web) 18 are passed through the nip formed between the printhead and a platen 20 while heat is selectively applied to the dye donor medium by image-wise energizing the heater elements that make up the thermal printhead. Dye is transferred from the dye donor medium to the dye receiver medium.

Platen 20 typically has an elastomeric surface which yields under pressure. This provides traction for the dye receiver medium, and also insures that the dye donor medium is pressed against the printhead despite any possible contouring which might be present in the printhead surface. FIG. 2 shows the effects of application of pressure by printhead 14 to the media and compliant platen 20. End portions 22 of platen 20 are not under pressure, and thus do not deform, or deform less than portions of the platen that align with printhead 14. This causes a bulge at end portions 22 during printing.

When, as in certain prior art thermal printer systems, dye receiver medium 18 is wider than the length of printhead 14, the dye receiver medium can be pressed into the edge of printhead 14 by the bulge in end portions 22 of platen 20. This causes undesirable print artifacts and scratches in the finished print.

SUMMARY OF THE INVENTION

The present invention is directed to overcoming one or more of the problems set forth above.

According to one feature of the present invention, a resistive thermal printer receives dye donor and dye receiver media between a printhead and a platen having an elastomeric surface. The platen and one of the media is wider than the printhead, and the other media is narrower than the printhead, whereby pressure between the printhead and the platen, with the media there between, tends to compress the platen in the region of the narrow medium. End portions of the platen beyond the narrow medium are relieved so as to not be compressed by pressure between the printhead and the platen.

In a preferred embodiment of the present invention, the end portions of the platen extend from the ends of the platen to at least the respective end of the printhead. The end portions may be chamfered, rounded, grooved, or otherwise reduced.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 3:
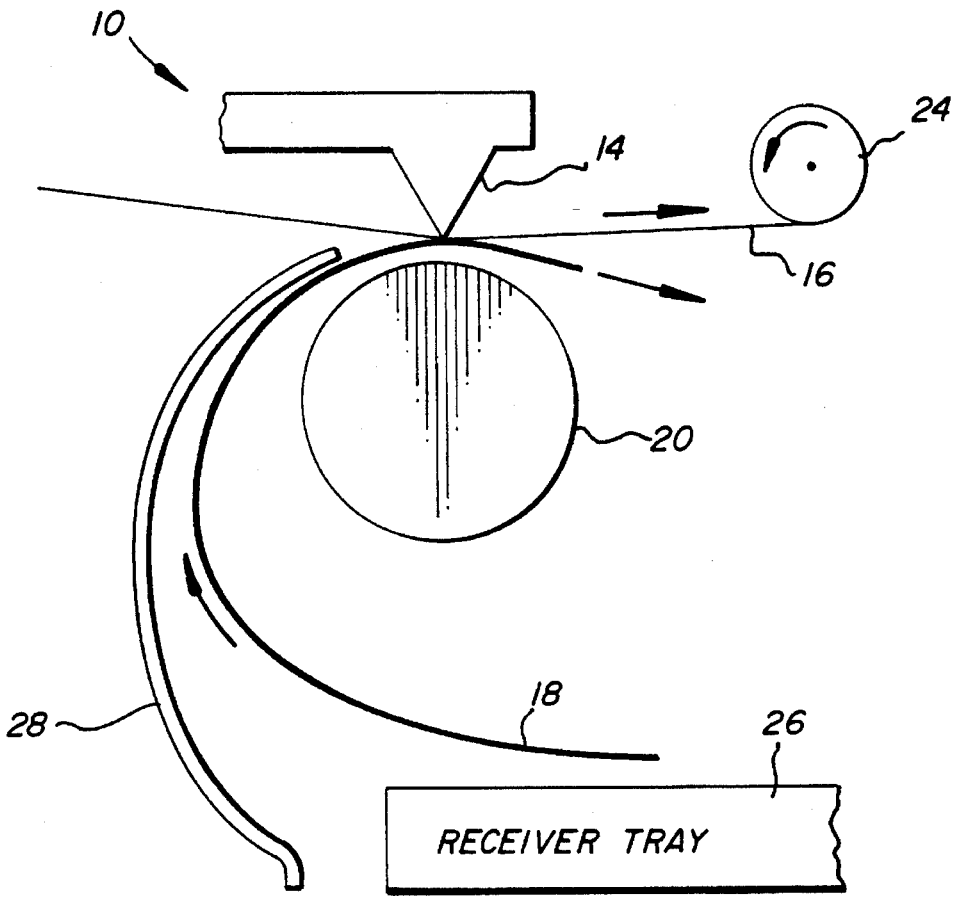
FIG. 3 is a side elevation view of a portion of a thermal printer according to a preferred embodiment of the present invention.

FIG. 3 illustrates a thermal printer 10, dye receiver medium 18, and dye donor medium 16 with take-up roll 24. Thermal printer 10 includes a thermal printhead 14, a platen 20 that supports dye receiver medium 18 as dye is transferred to the dye receiver medium, and a dye receiver medium supply 26. Platen 20 has an elastomeric surface to provide traction for the dye receiver medium and to insure that the dye donor medium is pressed against the printhead.

Figure 4:
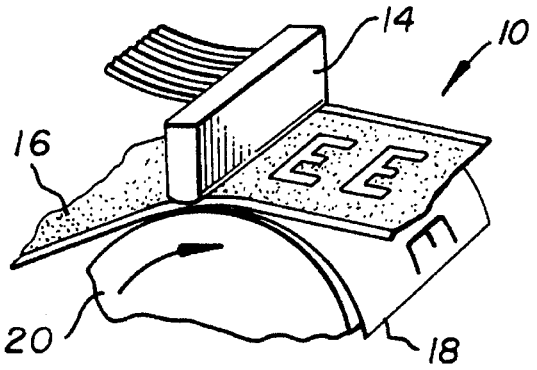
FIG. 4 is a perspective schematic view of a portion of the thermal printer of FIG. 1.

Normal thermal printer operations include loading dye receiver medium, printing information upon the dye receiver medium, and ejecting the finished print. In the loading phase, printhead 14 is moved away from platen 20, and a sheet of dye receiver medium is advanced from supply 26, along a curved guide member 28, to a printing location between the printhead and the platen. Printhead 14 may be moved to a print position, whereat dye receiver medium 18 rests against the circumference of platen 20. At the print position, printhead 14 is close enough to the platen to thermally transfer dye from dye donor medium 16 to dye receiver medium 18 when the printhead heater elements are activated; as illustrated in FIG. 4.

Figure 2:
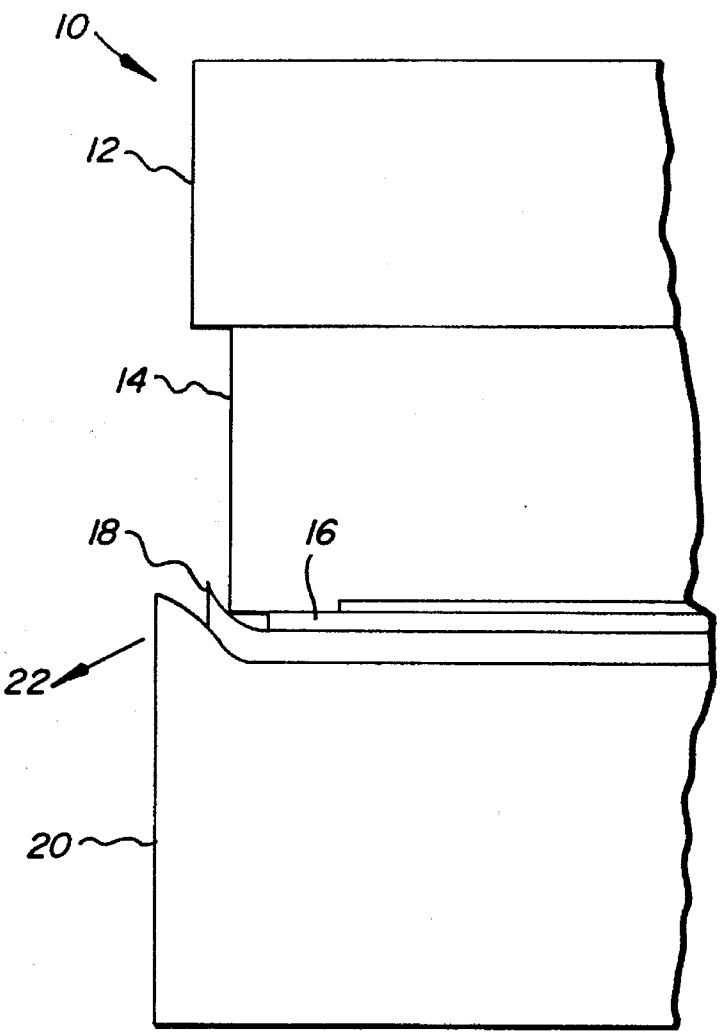
FIG. 2 (PRIOR ART)
FIG. 2 is a front elevation view of a printhead and platen according to the prior art, capturing dye donor and dye receiver media under pressure.
Figure 6:
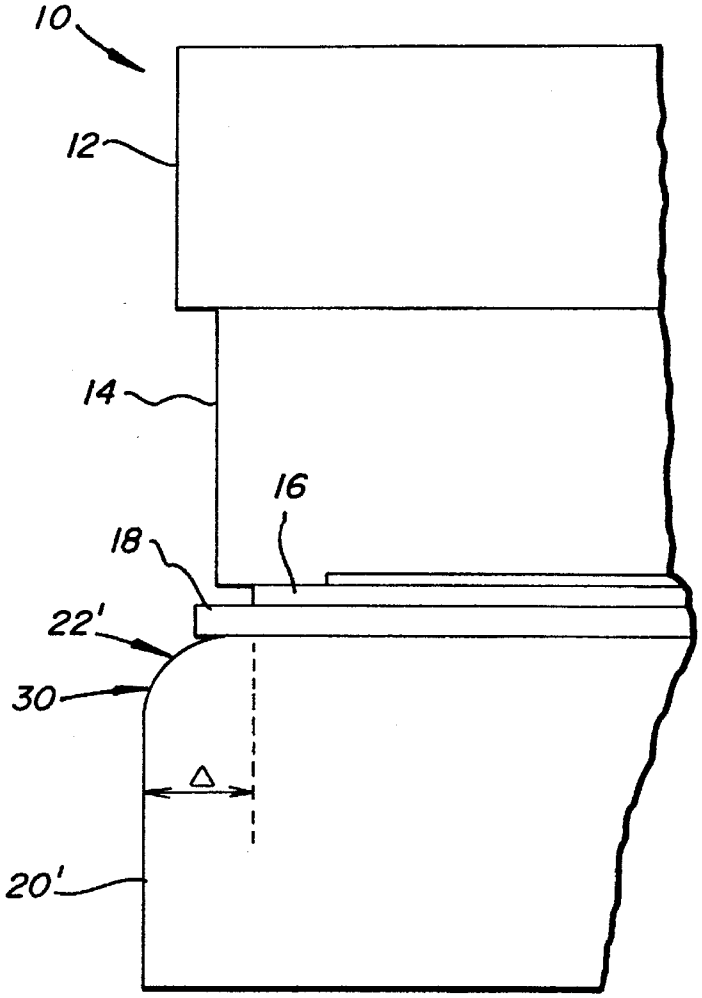
FIG. 6 is a front elevation view of a printhead and platen according to the present invention, capturing dye donor and dye receiver media under pressure.
Figure 5:
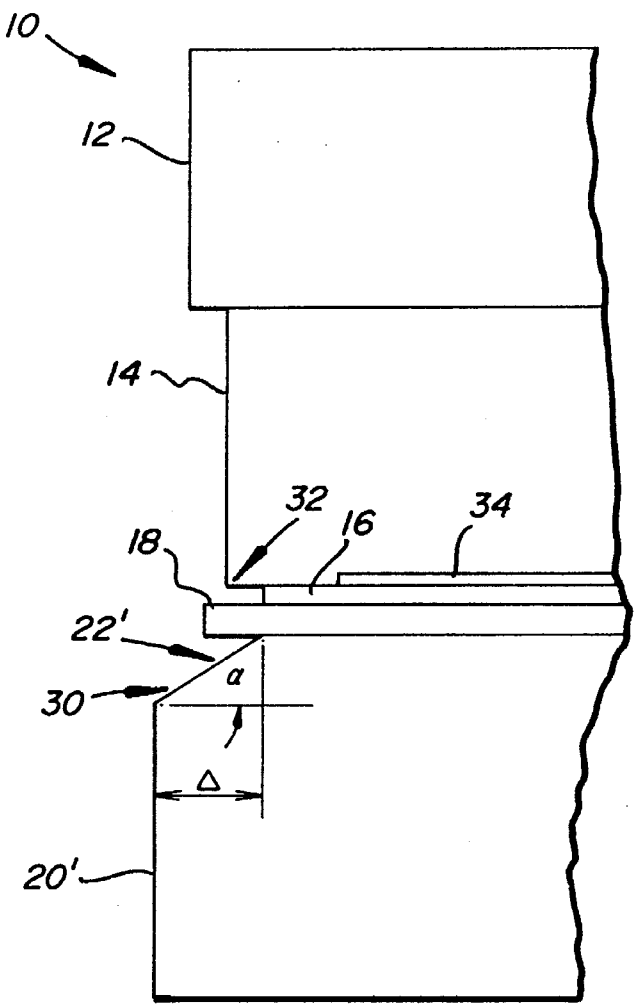
FIG. 5 is a front elevation view of a printhead and platen according to the present invention, capturing dye donor and dye receiver media.
Figure 7A:
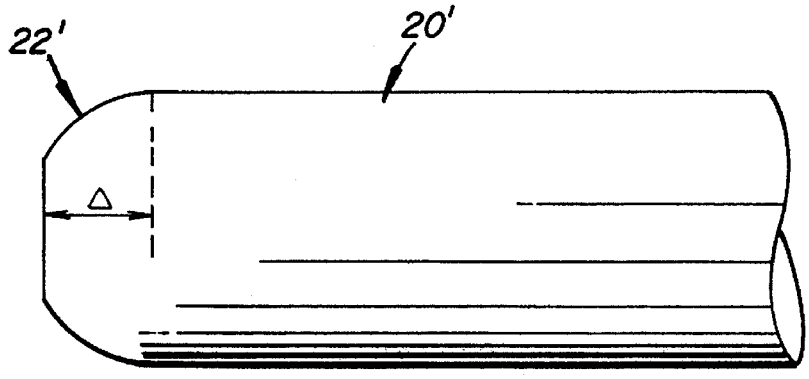
FIGS. 7(*a*), 7(*b*), 7(*c*) and 7(*d*) show a plurality of other platen shapes which can be used in the present invention.
Figure 7B:
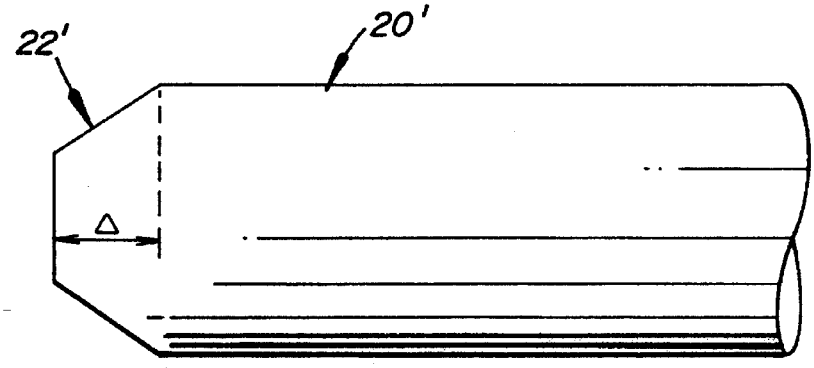
Figure 7C:
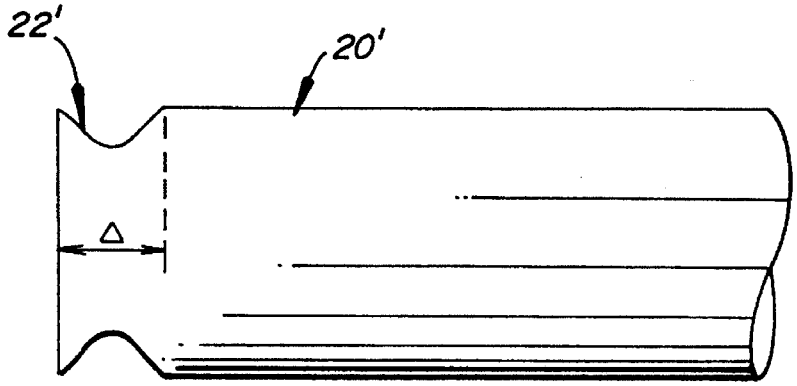
Figure 7D:
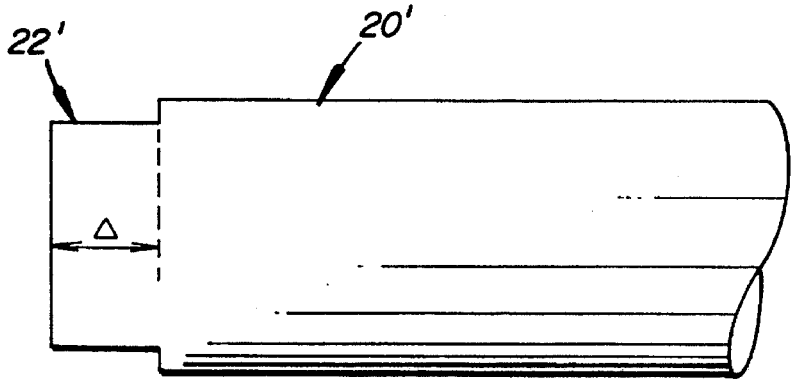

FIGS. 5 and 6 show two preferred embodiments of the present invention. Note that many elements illustrated in FIGS. 5 and 6 are the same as corresponding elements in FIGS. 1 and 2. Those elements have been identified with the same reference numeral as in FIG. 1. Elements that differ from FIG. 1 have been denoted in FIGS. 5 and 6 by primed reference numerals.

In FIG. 5, end portion 22' of platen 20' is relieved with a chamfer 30, forming an angle $\alpha$ with the axis of platen 20'. Angle $\alpha$ is sufficient to insure that dye receiver medium 18 is not pressed against printhead 14 when pressure is applied during printing. The distance $\Delta$ in FIG. 5 is the minimum effective depth of chamfer 30, and preferably is at least the distance from the end of platen 20' to the end 32 of printhead 14. The maximum effective depth of chamfer 30 is no more than the distance from the end of platen 20' to the end of the active resistive elements 34 of the printhead.

Figure 1:
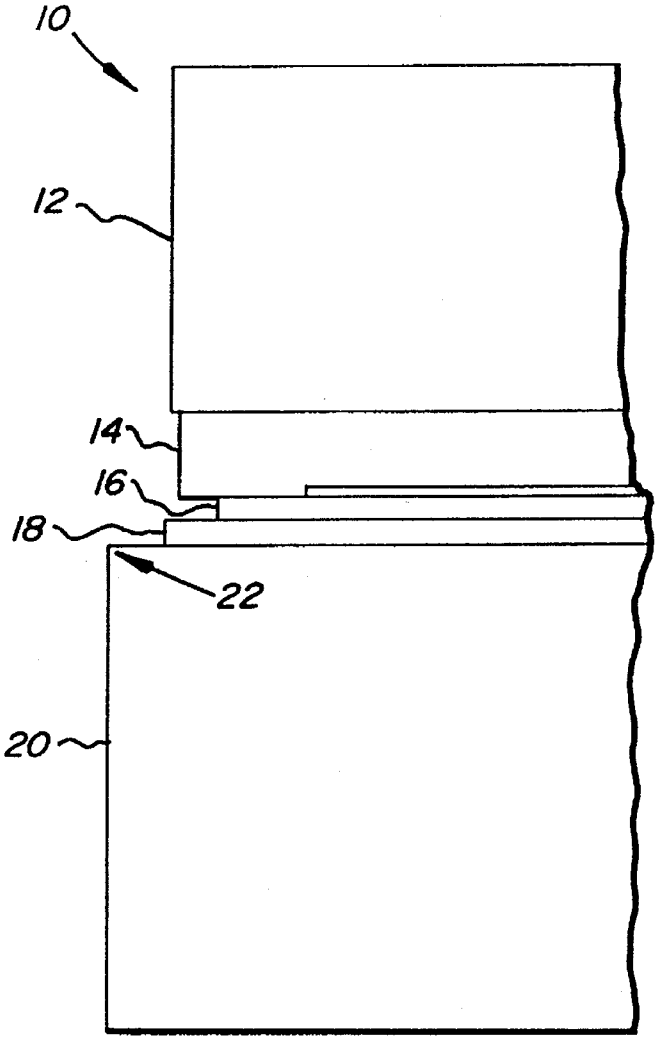
FIG. 1 (PRIOR ART)
FIG. 1 is a front elevation view of a printhead and platen according to the prior art, capturing dye donor and dye receiver media.

As with FIG. 1, the drawing in FIG. 5 shows the schematic arrangement of dye donor medium 16 and dye receiver medium 18 captured between printhead 14 and relieved platen 20', not accounting for yield in the platen due to pressure. FIG. 6 shows these components when pressure is applied by printhead 14 to squeeze dye donor medium 16 and dye receiver medium 18 against relieved platen 20'. In FIG. 6, the media sandwich is pressed into the yielding surface of platen 20', causing end portions 22', which have been chamfered at 30, to bulge. Because of chamfer 30, dye receiver medium 18 does not contact printhead 14, thus avoiding artifacts and scratches.

FIGS. 7(*a*) to 7(*d*) show a plurality of other shapes which can be used on the end portions 22' of platen roller 20' to avoid image artifacts and scratches. These shapes include, but are not limited to round ends as in FIG. 7(*a*), chamfered ends as in FIG. 7(*b*), grooved ends as in FIG. 7(c), and diameter-reduced ends as in FIG. 7(*d*). Other shapes will be readily apparent to those skilled in the art, it being required only that the end of the platen be relieved in a way that will prevent dye receiver medium 18 from contacting printhead 14.

While the invention has been described with particular reference to the preferred embodiments, it will be understood by those skilled in the art that various changes may be made and equivalents may be substituted for elements of the preferred embodiments without departing from the invention. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. In a resistive thermal printer having a printhead and a platen with an elastomeric surface, said printer being adapted to receive a dye donor medium and a dye receiver medium in a nip between the printhead and the platen, one of the media is wider than the printhead and the other media is narrower than the printhead, whereby pressure between the printhead and the platen, with the dye donor medium and the dye receiver medium there between, tends to compress the platen in a region of the platen aligned with the received other media; the improvement comprising end portions of the platen extending beyond the region of the platen aligned with the received other media, said end portions being relieved so as to allow room for bulging when the platen in the region of the received other media is compressed by pressure between the printhead and the platen.

2. The improvement as defined in claim 1 wherein:

the platen has ends: and said end portions extend from the ends of the platen to at least the respective end of the printhead.

3. The improvement as defined in claim 1 wherein said end portions are chamfered.

4. The improvement as defined in claim 1 wherein said end portions are rounded.

5. The improvement as defined in claim 1 wherein said end portions are grooved.

6. The improvement as defined in claim 1 wherein said end portions are reduced.

7. The improvement as defined in claim 1 wherein said platen is a cylindrical roller.

8. The improvement as defined in claim 7 wherein said end portions are cylindrically reduced.

* * * * *